United States Patent [19]

Spies et al.

[11] Patent Number: 4,838,166

[45] Date of Patent: Jun. 13, 1989

[54] CASING FOR THE PROTECTION OF EXPLOSIVE CHARGES

[75] Inventors: Hans Spies, Pfaffenhofen; Ulrich Weigel, Sinzig, both of Fed. Rep. of Germany

[73] Assignee: Messerschmitt-Bolkow-Blohm GmbH, Fed. Rep. of Germany

[21] Appl. No.: 941,615

[22] Filed: Dec. 15, 1986

[30] Foreign Application Priority Data

Dec. 19, 1985 [DE] Fed. Rep. of Germany ..... 3544929

[51] Int. Cl.[4] ..... F42B 41/00

[52] U.S. Cl. ..... 102/481; 60/223; 60/253; 102/282; 102/331

[58] Field of Search ..... 60/223, 253, 255; 220/900, 441–443; 89/34, 36.02; 102/430, 431, 464, 282, 481, 331

[56] References Cited

U.S. PATENT DOCUMENTS

| | | | |
|---|---|---|---|
| 1,381,175 | 6/1921 | Ericsson | 220/900 |
| 1,665,033 | 4/1928 | Jensen | 220/443 |
| 2,430,931 | 11/1947 | Hershberger | 220/900 |
| 3,173,364 | 3/1965 | Nordzell | 102/481 |
| 3,228,361 | 1/1966 | Ritter | 89/36.02 |
| 3,509,016 | 4/1970 | Underwood et al. | 220/900 |
| 4,010,690 | 3/1977 | Cocozella et al. | 102/282 |
| 4,041,869 | 8/1977 | Miguel | 102/481 |
| 4,411,199 | 10/1983 | Yates | 102/481 |
| 4,442,666 | 4/1984 | Vetter | 60/253 |
| 4,458,482 | 7/1984 | Vetter et al. | 102/481 |

*Primary Examiner*—Harold J. Tudor
*Attorney, Agent, or Firm*—McGlew & Tuttle

[57] ABSTRACT

A housing for the protection of explosive charges comprises several layers of different compositions surrounding the explosive charge. The successive layers have alternately a high and a low shock wave impedance, where further the outermost layer has the lowest melting point and the melting point increases toward the innermost layer.

11 Claims, 1 Drawing Sheet

CASING FOR THE PROTECTION OF EXPLOSIVE CHARGES

FIELD AND BACKGROUND OF THE INVENTION

This invention relates in general to ammunition and in particular to a new and useful casing for the protection of explosive charges.

The present invention relates in general to ammunition and in particular to a new and useful casing for the protection of explosive charges against bombardment and fire, comprising several layers of different compositions surrounding the explosive charge.

To protect explosive charges against bombardment or fire it is already known to use explosives of low sensitivity, these explosives having the disadvantage, however, that they are not usable in priming chains; also in other types of use considerable problems of initiation occur.

Providing a single mechanical damping layer between an envelope and an explosive charge is not very effective either, in particular in respect to impingement of impact projectiles.

From U.S. Pat. No. 4,010,690 a protective casing for ammunition is known which consists of several layers of different compositions surrounding the ammunition body. Next to the ammunition body is first an aluminum foil, then follows an insulating layer with a heat-reflecting layer, and lastly a foamed glass fiber layer, in order thus to protect the ammunition body against the action of fire.

From German OS No. 28 55 694 a container for keeping hazardous material is known, whose wall consists of a lamination which comprises an inner layer of relatively rigid fiber-reinforced plastic material and an outer layer of an elastomer material for protection against intruding projectiles.

SUMMARY OF THE INVENTION

The present invention provides a casing for the protection of explosive charges against bombardment as well as fire, which has an especially high thermal time constant and also damps intruding particles of projectiles especially effectively.

According to the invention, the explosive charge is surrounded by several layers with successively different shock wave impedances and different melting points, and, next to the outermost layer is an envelope with openings, the stagger of the melting points of the layers being arranged so that on heating the temperature rise is smallest at the explosive charge.

Advantageously the outermost layer contiguous to the envelopes has a high shock wave impedance, while the layer following this layer has a low shock wave impedance, the following layer has again a high shock wave impedance, and the layer nearest the explosive charge again a low shock wave impedance; the layers of low shock wave impedance may be made thinner than the layers of high shock wave impedance.

It is especially advantageous to give the contact surfaces between the layers of different shock wave impedance a sawtooth-shaped cross-section, which cross-sections may be staggered relative to each other. In an especially advantageous embodiment the sawtooth-shaped cross-sections are staggered relative to each other by one fourth of one period of the sawtooth form.

With the casing designed according to the invention, therefore, the advantage is achieved that explosive charges are protected especially effectively both against the penetration of projectiles or their fragments, as also against the actions of fire, as the casing has an especially high thermal time constant, so that it is usable also for sensitive parts of a priming chain.

Due to the alternating arrangement of layers of different shock wave impedance it is achieved at the respective joints that shock waves penetrating into the casing are reflected at the respective layers. Further the action of intruding articles is thereby greatly weakened.

Especially with the sawtooth-shaped form of the contact surfaces between the individual layers, an additional damping is achieved by the reflection at impedance shock points in the case of perpendicularly impinging particles or shock points.

Due to the rising melting points from the periphery inwardly, the advantage is achieved that under a temperature action from the envelope side the layers, in accordance with the staggered temperature, first melt and then evaporate successively, the respective vapor pressure escaping across the bores provided in the envelope. By this removal of the heat of melting and evaporation a very strong increase of the thermal time constant is obtained, so that in case of fire, e.g. in the ammunition dump the time for the initiation of measures is substantially extended.

Accordingly it is an object of the invention to provide an improved casing for the protection of an explosive charge which comprises a plurality of layers of different compositions surrounding the explosive charge which have successively different shock wave impedance and different melting points and an outermost layer includes an envelope having openings wherein the melting points of successive layers are arranged so that when subject to heating the temperature rise at the explosive charge is the smallest.

A further object of the invention is to provide a casing for an explosive charge which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
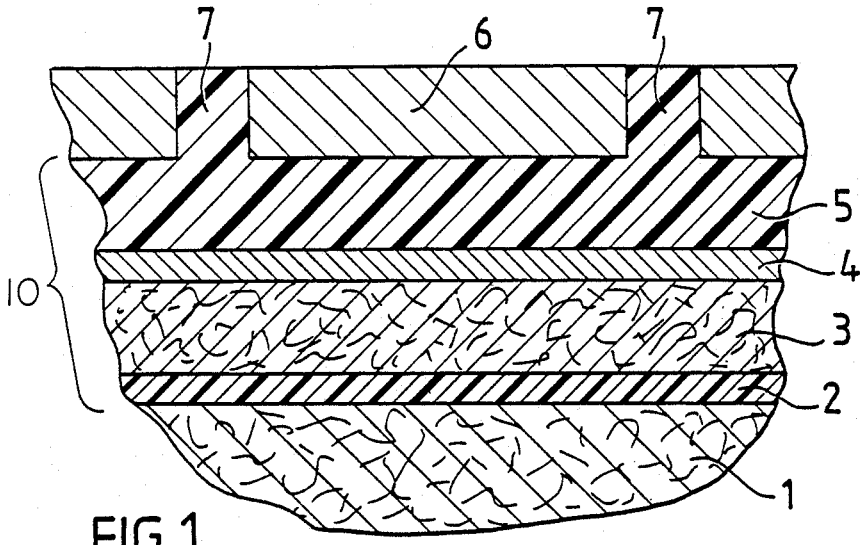
FIG. 1 is a transverse sectional view through a first embodiment of ammunition casing constructed in accordance with the invention.

Referring to the drawings in particular the invention embodied therein comprises a casing, generally designated 10, which comprises a plurality of layers of different compositions surrounding an explosive charge 1. The layers 2,3,4 and 5 have successively different shock wave impedances and diferent melting points. The outermost layer 6 comprises an envelope having openings 7 which in the embodiment shown in FIG. 1 is filled with material of the layer designated 5. Melting points of successive layers are arranged so that when they are subject to heating, the temperature rise at the explosive charge 1 is the smallest.

In the embodiment example illustrated in FIG. 1, 1 denotes schematically an explosive charge which is to be protected against the action of fire or projectiles by layers 10. For this purpose the explosive charge 1 is surrounded by a first layer 2, of a material of low shock wave impedance. Next to this layer is a second layer 3 of high shock wave impedance, next to it a layer 4 of low shock wave impedance, and next to it a fourth layer 5 again of high shock wave impedance.

Next to the outermost layer 5 of the layers 10 the is envelope 6, which is provided with a plurality of openings or bores 7, which are filled with the material of the outermost layer 5. The material of the layers is selected so that the outermost layer 5 has the lowest melting point and the melting point increases toward the innermost layer 2. This means that at a temperature effect from the whole envelope, first the outermost layer 5 melts and evaporates, the vapor being able to escape through the bore 7. Only thereafter the material of layer 4 and respectively of the layers 3 and 2 melts and evaporates. By this successively occurring melting and evaporating of the individual layers a very strong increase of the thermal time constant is achieved.

Figure 2:
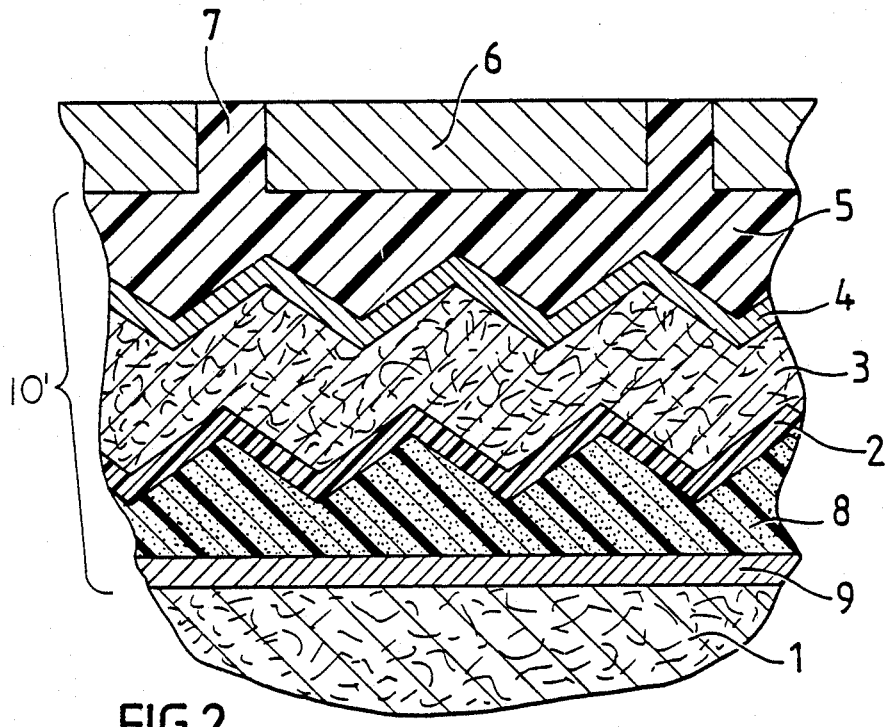
FIG. 2 is a transverse section similar to FIG. 1 of a second embodiment of a casing constructed according to the invention.

In the embodiment example shown in FIG. 2 of a casing according to the invention, includes a layer assembly 10' including the two layers of low shock wave impedance 2 and 4 are of sawtooth-shaped configuration so that the surfaces of the individual flanks of the sawtooth form with respect to the envelope 6 a defined angle therewith. The contact faces of the layers 5,3 as well as of an additional layer 8 are adapted to this sawtooth form. Between the additional layer 8 of high shock wave impedance just like layers 3 and 5 of FIG. 1 an additional layer 9 of low shock wave impedance Just like layers 2 and 4 of FIG. 1 may be present.

As can further be seen from FIG. 2, the damping of shock waves or respectively of perpendicularly impinging articles is improved by reflection at the impedance shock points also by the fact that the two layers 2 and 4 of sawtooth-shaped design are offset relatively to each other, namely over one fourth of the total period of the sawtooth form.

The casing according to the invention may, depending on the form of the explosive charge to be protected, may be of cylindrical or rectangular design. It can surround the explosive charge on all sides, one of the sides of the rectangular casing or one of the end faces of the cylindrical casing being removable.

An example of the materials used for the layers in FIG. 1 is as follows:

Layer No. 2: polyethylene
Layer No. 3 cardboard
Layer No. 4: lead
Layer No. 5: wax
Layer No. 6: Aluminum

What is claimed is:

1. A casing for the protection of explosive charges, comprising a plurality of layers of different compositions surrounding the explosive charge, said layers being successively arranged including an innermost layer adjacent said charge, an outermost layer the furthest from the charge in an envelope layer covering said outermost layer, said layers having successively different shock wave impedances alternating between a relatively high shock wave impedance and a relatively low shock wave impedance relative to each other and having different melting points, said envelope surrounding said outermost layer having at least one opening therein, the melting points of successive layers being different with the outermost layer having the lowest melting point and said layer adjacent said charge having the highest melting point so that upon heating the temperature at the explosive charge is the smallest, said outermost layer contiguous to the surrounding envelope having a high shock wave impedance, the next innermost layer having a low shock wave impedance, the next innermost layer having a high shock wave impedance and the layer contiguous to the explosive charge again having a low shock wave impedance.

2. A casing according to cliam 1, wherein layers which have a low shock wave impedance are thinner than the layers of high shock wave impedance.

3. A casing according claim 1, wherein some of said layers have contact faces with a next adjacent layer of sawtoothed-shaped cross-section.

4. A casing according to claim 3, wherein said sawtoothed shaped cross section are periodic, the period of each layer of sawtoothed-shaped cross section being offset relative to the period of the next adjacent layer sawtoothed-shaped cross section.

5. A casing according to claim 4, wherein said sawtoothed-shaped cross-sections are staggered relative to each other by one fourth of one period of the sawtoothed form.

6. A casing for an explosive layer comprising a first layer having a low shock wave impedance and being relatively thin covering said explosive charge, a second layer having a high shock wave impedance covering said first layer, a third layer having a low shock wave impedance covering said second layer, a fourth layer of high shock wave impedance covering said third layer and an envelope covering said fourth layer having openings into which said fourth layer protrudes, said layers having melting points which decrease toward the outer surface of said casing.

7. A casing according to claim 6, wherein all of said layers except said first layer have contact surfaces of wave form.

8. A housing for the protection of explosive charges, comprising a plurality of layers of different compositions surrounding the explosive charge, said layers being successively arranged including an innermost layer adjacent said charge, an outermost layer the furthest from the charge in a shell covering said outermost layer, said layers having successively different shock wave impedances alternating between a relatively high shock wave impedance and a relatively low shock wave impedance relative to each other and having different melting points, said shell surrounding said outermost layer having at least one opening therein, said outermost layer adjacent said shell having a high shock wave impedance relative to the other layers, the layer following said outermost layer proceeding toward the explosive charge having a low shock wave impedance, the next layer having a high shock wave impedance and the layer next to the explosive charge having a low shock wave impedance.

9. A housing according to claim 8, wherein the layers of low shock wave impedance are thinner than the layers of high shock wave impedance.

10. A housing according to claim 8, wherein said layers of different shock wave impedances have faces which are of a zig zag shape.

11. A housing according to claim 10, wherein said zig zag shape layers are periodic, the period of each zig zag shaped layer being offset relative to the period of the next adjacent zig zag shaped layer.

* * * * *